United States Patent [19]

Covino et al.

[11] Patent Number: 4,637,864

[45] Date of Patent: Jan. 20, 1987

[54] ELECTROCHEMICAL SYNTHESIS OF TERNARY PHOSPHIDES

[75] Inventors: Josephine Covino; George E. McManis, both of Ridgecrest, Calif.

[73] Assignee: The United States of America as represented by the Secretary of the Navy, Washington, D.C.

[21] Appl. No.: 846,788

[22] Filed: Mar. 28, 1986

[51] Int. Cl.[4] ..... C25B 1/00
[52] U.S. Cl. ..... 204/61
[58] Field of Search ..... 204/60, 61

[56] References Cited

U.S. PATENT DOCUMENTS 3,725,221 4/1973 Gomes et al. ..... 204/61

*Primary Examiner*—Howard S. Williams
*Attorney, Agent, or Firm*—W. Thom Skeer

[57] ABSTRACT

This invention comprises a method of synthesizing ternary phosphide compounds of the general formula $M(II)M(IV)P_2$ by fused salt electrolysis in which a melt powder mixture containing phosphorus compounds is introduced into an electrolytic apparatus containing a liquid group II metal cathode and a group IV metal or semiconductor source. Electrolysis occurs under controlled conditions in which oxygen is excluded as an impurity to produce the desired ternary phosphide compounds.

6 Claims, No Drawings

ELECTROCHEMICAL SYNTHESIS OF TERNARY PHOSPHIDES

BACKGROUND OF THE INVENTION

1. Field of the Invention

This invention is related to transmitting ceramic materials and, more particularly, to ternary phosphides useful as infrared materials in the 8 to 12 micron wavelength range in such applications as satellite windows and missile domes. This invention also relates to a new electrochemical synthesis of ternary phosphides.

2. Description of the Prior Art

Phosphides, sulfides and compounds with mixed sulfide-phosphide anions are used as 8–12 nanometer transmitting materials because they have excellent thermal, mechanical and optical properties. These materials are used for sensor windows and domes on satellites, missiles and other similar devices. However, high speed missiles operating at microwave and radar frequencies suffer from boresight errors and error slopes due to changes in the radome material dielectric properties caused by aerothermal heating. Currently available or developing materials such as ZnS, ZnSe, GaAs, Ge and $CaLa_2S_4$ do not meet the proposed optical requirements or stringent environmental operating standards.

In general, materials with strong chemical bonds exhibit good thermochemical properties but poor IR transmission. Conversely, most materials showing good IR transmission possess weaker chemical bonds and poor thermal and mechanical properties. For example, cubic crystalline structures often exhibit useful IR transmission, but these same structures have lower strengths than non-cubic analogues and are more susceptible to thermal shock. Compounds with the chalcopyrite structure ($ABC_2$), such as $ZnSiP_2$ and $ZnGeP_2$, have desirable optical and mechanical properties for use as IR transmitting ceramics in the 8–12 micron wavelength region. Furthermore, $MgGeP_2$ has been reported to go through a high temperature phase transition from the chalcopyrite to the diamond structure. Thus a method exists for toughening the chalcopyrite phase.

The preferred method of synthesizing ternary phosphides and mixed sulfur-phosphorous compounds is by direct combination of the elements typically using chemical vapor transport with a halogen, flux growth with fluxes such as Sn, Sb, Pb and Zn, or by crystal growth under pressure. Electrochemical synthesis in molten metaphosphates is a known method of preparing simple transition metal binary phosphides. However, there have been few reported electrochemical syntheses of non-transition metal phosphides and the applicants have found no reports of the electrochemical synthesis of ternary or higher phosphides. The electrochemistries of group IV components of the ternary compounds are difficult to control. Silicon and germanium are semiconductors that passivate readily in oxidizing media, particularly at the elevated temperatures needed to form the ternary compounds. No such passivation of the group IV components occurs in non-oxidizing media such as molten chlorides and fluorides. However, melts showing electrochemistry favorable for the group IV components generally have an unfavorable phosphorus chemistry. Conversely, melts which show favorable phosphorus chemistry are generally oxide rich and passivate and precipitate the group IV species as an insoluble oxide.

The production of silicon containing ternary phosphides presents a particularly difficult challenge since the choice of a silicon source is a critical factor in determining the products that are produced and the yield of those products. The design of a practical silicon source is a significant problem since the use of a pure silicon cathode is not practical because of its high electrochemical resistance. Similarly, silicon has a high melting temperature and is nearly insoluble in the molten tin or molten zinc used in the cathode. The choice of a practical silicon source is further limited by the fact that no zinc silicides are known.

SUMMARY OF THE INVENTION

Ternary ceramic compounds of the general formula $M(II)M(IV)P_2$ are synthesized by fused salt electrolysis. In the method of the present invention, a melt powder mixture containing phosphorus compounds is placed in an electrolytic apparatus having a liquid metal electrode as a group II metal source and as the active cathode surface. Sulfur and sulfur-phosphorus compounds will also work as melt powder mixtures. Halide melts such as NaCl/KCl eutectic may be used as well if a phosphorus source such as $KPF_6$ is present. The cathode is then surrounded by a group IV metal or semiconductor source. Next, the sealed apparatus is purged with an inert gas. Upon heating, the cathode melts and mixes with the group IV metal or semiconductor source. After the melt powder liquifies, an electric current is applied for several hours. An inert gas stream is used to remove oxygen produced during electrolysis.

The present invention prevents passivation of group IV components by removing oxygen with an inert gas. This allows the use of melts with favorable phosphorus chemistry. The present invention also solves the problem of finding a practical silicon source by using $Mg_2Si$, $Na_2SiF_6$, $SiO_2$ or elemental silicon. Additionally, electrochemical synthesis of the ternary compounds conveniently yields large quantities of materials which usually form only at high temperatures or high pressures or both. The reduction of the melt at high current densities results in the production of very reactive elemental phosphorus. During the high rate reductions, any metal in the cell forms a phosphide through direct combination of the elements. This electrochemical production of very reactive phosphorus in a melt has the advantage that phosphides which are not generally stable can be produced. Furthermore, purer products with controlled particle sizes can be synthesized since the reaction is relatively fast compared to conventional direct combination of the elements. The electrochemical process is inherently inexpensive and readily scaled to commercial production.

OBJECTS OF THE INVENTION

An object of this invention is to synthesize infrared transmitting materials which can be further processed into infrared transmitting ceramics.

Another object of this invention is to provide a fast and inexpensive synthesis of 8–12 micron wavelength transmitting materials having the chalcopyrite structure.

Yet another object of this invention is the synthesis of non-transition metal ternary phosphides of high purity.

Other objects, advantages and novel features of the invention will become apparent from the following description.

DESCRIPTION OF A PREFERRED EMBODIMENT

According to the teachings of the present invention 8–12 micron wavelength transmitting materials having the chalcopyrite structure have been synthesized by fused salt electrolysis. The materials are ternary phosphides having a generalized formula $M(II)M(IV)P_2$, wherein M(II) represents group II metals such as zinc, or alloys of group II metals with tin and M(IV) represents group (IV) metals such as zirconium and group (IV) semiconductors such as silicon and germanium.

The electrochemical cell for the method of the present invention consisted of a thick-wall quartz vessel approximately ¾ inch inner diameter. The cell cathode was a molten pool of zinc, zinc-tin alloy or pure tin approximately 3 $cm^2$ centered in the hot zone of a vertical tube furnace. The electrolyte melt material consisted of $NaPO_3$, an equimolar mixture of the $NaPO_3/KPO_3$ eutectic or a halide melt such as the KCl/NaCl eutectic combined with a phosphorus source such as $KPF_6$. Sulfur or sulfur-phosphorus compounds may also be used as electrolyte melt material. Silicon sources included $Mg_2Si$, $Na_2SiF_6$, $SiO_2$ and elemental silicon Germanium sources included $GeO_2$ and elemental germanium. Part of the silicon or germanium source may be mixed in with the electrolytic melt. Stoichiometric amounts of all materials were used although excess silicon was often included to correct an apparent silicon deficiency in the product. A carbon rod immersed in the melt was used as an anode. The cell was normally loaded with electrolyte and then purged with argon for 30 to 45 minutes to remove oxygen. Next, the cell was heated to a temperature above 1000° C. The silicon or germanium source mixed intimately with the cathode. Since the melting point of zinc, tin or zinc-tin alloy is lower than the melting point of electrolyte material, cathode prefusion normally occurred during the initial heating.

The cell was run at a constant 4 to 5 volt potential. Argon flow continued throughout the electrolysis to prevent the build-up of significant quantities of oxygen formed by the anodic reaction. Since oxygen is formed throughout the electrolysis, more rigorous steps to exclude oxygen from the cell were not used. Initial current densities were over 2 $A/cm^2$. The current diminished as the reaction proceeded because the electrode surface slowly changed from metallic to semiconductive binary phosphide. At temperatures over 1000° C., the binary phosphides chemically decompose and stable electrolysis currents near 500 $mA/cm^2$ are observed. It should be noted that the electrolysis has been successfully run at temperatures below 1000° C. Electrolysis times ranged from 2 to 12 hours. The ceramic material was later recovered by leaching with an acid wash containing $HNO_3$ or HCl or by mechanical means.

Electrolysis rate and temperature were found to be important variables in determining whether the predominant products are ternary or binary phosphides. Binary phosphides are formed at temperatures below the boiling point of the zinc cathode which is approximately 906° C. Above 1000° C., transport of zinc and silicon sources occur readily, and in the atmosphere of nearly pure elemental phosphorus maintained by the reduction of the phosphorus source onto the cathode, the ternary phosphide is formed by the direct combination of the elements on the walls of the cell.

The chemical nature of the silicon donor is another important factor influencing the production of the ternary phosphides. The best product yield was obtained with silicide and hexafluorosilicate silicon sources.

The following examples are given to illustrate but not limit the invention.

EXAMPLE 1

Anhydrous $NaPO_3$ was heated to 400°–500° C. in air to ensure that the salts were as dry as possible. $KPO_3$ was formed by dehydrating $KH_2PO_4$ at 500°–600° C. An equimolar mixture of anhydrous $NaPO_3/KPO_3$ electrolyte was introduced into a thick wall quartz vessel approximately ¾ inch in internal diameter. The electrolyte contained 9.26 g of $NaPO_3$, 10.72 g of $KPO_3$ and 6.26 g of $Na_2SiF_6$. This electrochemical cell contained a liquid metal cathode approximately 3 $cm^2$ in area and centered in the hot zone of a vertical tube furnace. The cathode contained approximately 2.12 g of Zn, 12.82 g of Sn and 3.13 g of $Na_2SiF_6$. A carbon rod approximately ¼ inch in diameter was immersed 1–2 inches into the melt and was used as the anode. The electrochemical cell was purged with argon for 30–45 minutes to remove oxygen. Argon flow was continued throughout the synthesis to prevent the build-up of oxygen formed by the anodic reaction. Next, the cell was heated to a temperature above 1000° C. in the vertical tube furnace The cell was then run for 6 hours at a constant 5 volt potential. Initial current density was about 2 $A/cm^2$. Current density later stabilized near 500 $mA/cm^2$.

The resulting ternary phosphide $ZnSiP_2$ was identified and characterized using X-ray powder diffraction data, scanning Auger microprobe spectroscopy and X-ray photoelectron spectroscopy.

EXAMPLE 2

Utilizing the procedure of example 1, approximately 20 g of anhydrous $NaPO_3$ was used for the electrolyte melt. The cathode contained approximately 25 g of Zn and 2 g of elemental silicon. The cell was run at 850° C. and a constant 4 volt potential for 11 hours. The ternary phosphide $ZnSiP_2$ was produced.

What is claimed is:

1. A method for the electrochemical synthesis of ternary phosphides of the general formula $M(II)M(IV)P_2$ by fused salt electrolysis comprising:

forming a melt powder mixture of compounds containing phosphorus;

placing said melt powder mixture in an electrolytic apparatus having a liquid metal cathode containing a silicon source and Zn metal source;

heating said electrolytic apparatus containing said melt powder mixture and liquid metal cathode to a temperature of 1000° C. or greater to form a molten mixture;

electrolyzing said molten mixture at a potential of about 4.0 to 5.0 volts to form a fused reaction melt in which oxygen is excluded as an impurity; and cooling the mixture and recovering the resulting ceramic compound from said melt by leaching with an acid wash.

2. The method of claim 1 wherein said melt powder mixture is selected from the group consisting of $NaPO_3$, the equimolar $KPO_3/NaPO_3$ eutectic, or the KCl/NaCl eutectic combined with a $KPF_6$ phosphorus source.

3. The method of claim 1 wherein oxygen is excluded as an impurity by purging with an inert gas.

4. The method of claim 1 wherein significant oxygen buildup is prevented during the electrochemical synthesis by continuous flow of an inert gas.

5. The method of claim 1 wherein said liquid metal cathode comprises the group II metal zinc or an alloy of tin and the group II metal zinc whereby said cathode forms a molten pool of metal in said melt powder.

6. The method of claim 5 wherein said liquid metal cathode is intimately mixed with a silicon source selected from the group consisting of $Mg_2Si$, $Na_2SiF_6$, $SiO_2$ and elemental silicon.

* * * * *